United States Patent [19]

Percinel et al.

[11] Patent Number: 4,725,220

[45] Date of Patent: Feb. 16, 1988

[54] APPARATUS FOR COMPACTING NEWLY POURED CONCRETE BY DIRECTLY COUPLED VIBRATION

[75] Inventors: Omer Percinel; Jorgen Fisher, both of Lyngby, Denmark

[73] Assignee: Fischer & Nielsen, Lyngby, Denmark

[21] Appl. No.: 827,961

[22] PCT Filed: May 24, 1985

[86] PCT No.: PCT/DK85/00051

§ 371 Date: Jan. 29, 1986

§ 102(e) Date: Jan. 29, 1986

[87] PCT Pub. No.: WO85/05590

PCT Pub. Date: Dec. 19, 1985

[30] Foreign Application Priority Data

May 29, 1984 [DK] Denmark ..... 2637/84
Jan. 23, 1985 [DK] Denmark ..... 297/85

[51] Int. Cl.[4] ..... B28B 1/08; B30B 7/04

[52] U.S. Cl. ..... 425/406; 264/72; 425/410; 425/429; 425/432

[58] Field of Search ..... 264/70, 71, 72; 425/429, 432, 410, 421, 456, 406

[56] References Cited

U.S. PATENT DOCUMENTS 4,531,903 7/1985 Frey et al. ..... 425/429

FOREIGN PATENT DOCUMENTS 67139 6/1948 Denmark .
78921 2/1955 Denmark .
1784761 11/1971 Fed. Rep. of Germany .
1784661 1/1975 Fed. Rep. of Germany .
2453634 5/1976 Fed. Rep. of Germany .
2552852 5/1977 Fed. Rep. of Germany .
3022602 1/1981 Fed. Rep. of Germany .
1381755 11/1964 France .

*Primary Examiner*—Jan H. Silbaugh
*Assistant Examiner*—Karen D. Kutach
*Attorney, Agent, or Firm*—Merchant, Gould, Smith, Edell, Welter & Schmidt

[57] ABSTRACT

A method and an apparatus for compacting newly poured comparatively dry concrete or similar porous plastic raw materials (6) with a direct mechanically coupled 3-mass oscillatory system where the raw material in its confined form is vibrated and compacted from both sides by two vibrating planes with synchronized directional vibrations in phase opposition. Only one vibrating plane (M1) includes synchronized directional vibrators (4). Its other part (M3) is elastically coupled with (M1) by spacer means (8) (M2) arranged between a spring system (7) being so dimensioned that the parts is dynamically balanced whereby the two parts (M1) and (M3) oscillate in phase opposition close to or at the 2nd natural frequency of the system with a dynamic amplification of the amplitudes in relation to the impulses imparted from the vibrators (4) at the same time while (M2) is stationary. During the process (M1) and (M3) are carried towards each other by (M2) as the raw material is gradually compacted.

6 Claims, 9 Drawing Figures

Porosity of compacted and traditional concrete

APPARATUS FOR COMPACTING NEWLY POURED CONCRETE BY DIRECTLY COUPLED VIBRATION

The invention relates to a method concerning compacting newly formed concrete and the like by synchronized vibrations applied to opposite sides thereof, and to an apparatus for carrying out the method.

By conventional industrial production of concrete such as of large concrete units where the particles of the concrete are rearranged by gravitation and where it is the object of the vibration to reduce the surface forces between the particles, there is often with a view to the workability of the concrete added a large amount of cement and an amount of water that is 2–3 times larger than necessary for completely hydrating the cement.

If the cement paste content is too big and moreover filled with pores due to insufficient vibration and/or too big water content, a break in the hardened concrete unit will extend in the cement paste coating the aggregate. This is due to the fact that the weakest component in concrete is the cement paste. The strength of the aggregate is normally 3–5 times greater than that of the cement paste.

Accordingly, it is important that the leanness of the concrete defined as the ratio of aggregate to cement (a/c) is as great as possible to obtain maximum material properties.

By intensively compacting lean and comparatively very dry concrete the rate of strength development as well as final strength and the modulus of elasticity of the concrete are improved.

The rate of strength development depends on the degree of compacting so that an increase in the specific weight of the concrete by 1% results in a reduction in hardening time by approx. 25%.

There is moreover obtained increased resistance to outer physical and chemical attacks, e.g. improved waterproofing and frost safeness. Concrete with a water/cement (w/c) ratio below 0.4 is considered frost safe.

By intensive compaction the poor properties of the concrete are reduced with a view to carbonization as well as creeping and contraction.

The problem of achieving such greatly improved properties has hitherto been that by the low w/c ratios it has not been possible to rearrange the particles of the concrete to reach sufficient compactness the result being enclosed voids at a number and distribution acting as break promoters in the concrete.

During recent years producers have therefore added super-plastifiers to the concrete mixes thus reducing friction between the individual constituents of the concrete mix so that it is possible to work with a water/cement ratio of about 0.25 when simultaneously applying vibration.

These plastifiers are organic substances that are added to the concrete mix and the long-term effects thereof are not known. Moreover, the use of plastifiers has the effect that the adhesion of the concrete to the reinforcement is reduced. It is therefore desirable to be able to avoid additives of any kind so that there are only used mineral, i.e. inorganic, constituents in a concrete mix.

From German published specification DE No. 24 53 634 the technique of which is today applied by all hitherto known concrete product machines it is known to compact the enclosed mass of concrete by transmitting the vibration from an underlying vibrating table and through the concrete make a mass resting on the concrete oscillate. In this case the spring action of the piston in the cylinder is performed by having same connected with a hydraulic accumulator forming the spring unit. By adjusting the pressure in the cylinder it is possible to make the upper part oscillate when the squeeze pressure has been suitably balanced.

The arrangement is not a 2-mass system because the spring unit is not connecting the two masses. On the contrary the two masses with spring system belonging thereto each form a system with one mass and one degree of freedom where by means of a static squeeze pressure the vibration is transmitted from the part containing the vibrator to the upper piston via the concrete.

The low efficiency of this oscillation system is due to the following:

(1) at the moment of impact the counter-oscillating part reduces the amplitude of the supplied impulses from the oscillating part containing the vibrator, (2) the oscillatory amplitude of the counterpart becomes dampened by the plastic impact with the deformable object, (3) there is no rebounding force for the counterpart unless the static squeeze pressure is high (but then rearrangement of the concrete during the process is hindered), (4) cylinder dampening due to friction between piston and cylinder wall and to throttling loss in the oil, (5) the reactions in the base give a great energy loss and noise to the surroundings.

In order to achieve as described above that the amplitudes are phase displaced 180 degrees in relation to each other an outwardly excited oscillatory system with one degree of freedom will have to work highly overcritical (approx. 5–10 times) but then the amplitude of the upper piston will approach zero and thus also the dynamic force. In this way only the generally known stamping is achieved where the vibrator strikes against a firm backstop.

If as stated in German published specification DE No. 24 53 634 the oscillatory system was in resonance for achieving maximum amplitudes, the frequency would have to be kept within a range of +/− 5% but at that point the phase angle is only offset 90 degrees and not 180 degrees as mentioned in the text and shown in the drawing. The vibrator mounted on the upper piston is only used for releasing the finished object by the stripping.

From German published specification DE No. 25 52 852 it is known to compact the enclosed concrete mass by transmitting the vibration from an underlying vibrating table through the concrete and making a mass resting on the concrete oscillate by making rebounds. There are no regular spring assemblies, i.e. the ballast plate merely rests on the concrete surface thereby limiting the impact force of the ballast plate to the pull of gravity. It is also described that the plate can be connected with cylinders which if being springy must then be adjusted to the mass and the frequency as otherwise only the generally known stamping is obtained. The upper part of the system with ballast piston is like DE No. 24 53 634 an oscillation system which is excited from outside and through the concrete with the resulting low efficiency and particularly because of the cylinder dampening there being no spring system. The hydraulic cylinders mounted between machine frame and mould frame are merely used for opening and closing the mould.

From German published specification DE 30 22 602 it is likewise known to compact an enclosed concrete mass by two-sided vibration with a superposed static pressure through the concrete. There vibration is transmitted to the upper piston which is simultaneously making slow horizontal calendering movements during the process. The oscillatory principle is as by the two above-mentioned an outwardly excited oscillation system but here with particularly large damping of the transmitted impulses between the pistons and the stationary cylinders because there are no kind of spring elements thereby reducing the amplitude of the upper part. As mentioned above the amplitude of the transmitted impulses are further reduced by the counter-oscillating lower part and by the plastic impact with the deformable object. Also in this case the reactions of the cylinders against the base are lost with resulting energy loss.

By this oscillatory system where mould and unit are placed on the counter-oscillatory lower part, the natural frequencies of the machine are changed dependent on the mass of mould and unit. It is therefore necessary to change the working area of the machine individually in order to obtain optimum compression but then the dynamic force is simultaneously changed.

The object of the invention is to provide a method and an apparatus whereby it is possible to produce high quality concrete with a low content of water and cement and with a (w/c) ratio reduced to a value close to the theoretical minimum of approx. 0.25–0.3 for obtaining complete hydrating.

According to the invention the two large masses exerting the dynamic forces on the plastic object are directly mechanically connected through the third mass for example the cylinders by means of spring elements and thus provide a true multiple mass system that can also be characterised in that the oscillation may take place whether there is concrete in the mould or not.

During the process the two large masses thus form each other's base in that the impulse forces are equally large and opposite which was also established by measurements in that the cylinders connecting the two masses stand still during the process.

This is achieved by proceeding as disclosed herein, for example by utilising an apparatus as disclosed. By intensively compacting concrete, however, it is not only the water/cement ratio which can be reduced but also the absolute cement content per $m^3$ concrete. The concrete mix contains no plastifying additives whatsoever, i.e. it solely contains the original inorganic constituents: water, cement, sand and stone. There is thereby obtained a highly uniform product having a more compact structure than in the known products and thus a highly durable concrete with faster strength development and much higher ultimate strength.

The compacting machine is designed as a mechanically coupled oscillatory system and is made as a 3-mass system in such a manner that the compacting masses oscillate in phase opposition. By the new process it is a matter of a highly intensive two-sided actuation of the plastic object such as newly poured concrete, newly poured chipboard pulp, moulding sand and similar plastic masses where the enclosed object can be acted on by huge dynamic forces.

Since the compacting machine is designed as a mechanically coupled oscillatory system, it will oscillate without an overlaid static contact pressure with the mould. It is thereby ensured that the rearrangement of the material is not hindered during the compacting process contrary to the known concreting machines which must all transmit the impulses through the concrete.

Contrary to the above identified known oscillation systems with one degree of freedom where the amplitude of the counterpart is reduced by the transmission of the vibrational forces through the plastic object, the invention provides enhanced oscillation of both parts compared with the amplitude imparted by the vibrators since the oscillation of the two parts are dynamically coupled and operate close to their 2nd natural frequency. This natural frequency is independent of the weight of mould and unit because the dynamic actuation is of the same order on both sides of the object and because the opposed accelerations of the planes are several times higher than acceleration due to gravity; i.e. the object "drifts" between the two planes and thus the mass of the object does not influence the 2nd natural frequency of the oscillatory system.

By proceeding as disclosed, for example by utilising an apparatus as disclosed, it is ensured that the vibrational energy continues to penetrate into the newly poured concrete as the compacting proceeds and the thickness of the unit is reduced.

The machine is designed as a 3-mass system wherein for example hydraulic cylinders with pistons or similar devices are used such as screw joints that gradually reduce the distance between the two planes as the compacting process proceeds.

By this efficient vibrational system where the machine works close to the 2nd natural frequency of the oscillatory system, the machine operates as a mechanical dynamic amplifier of the transmitted impulses. The spring system is balanced in such a manner that there may be obtained an amplification of the dynamic forces corresponding to approx. 10 times the vibrator force, such having been established by tests by measurements made with a two channel oscilloscope.

The two parts of the machine are made as highly rigid structures so that no bending oscillations will occur within the working area which could otherwise give rise to uneven compacting.

The spring system has been so balanced that the amplitudes of the cylinders are minimised in relation to the other masses and thus it is achieved that the opposite amplitudes of the two planes become as high as possible. Moreover, the amplitude of the pistons in the cylinders are minimised by applying a relatively high hydraulic pressure on both sides of the piston. There is thus also achieved a high efficiency of the transmitted vibrational energy in that the spring action is solely performed by the spring members arranged for that purpose and not in hydraulic cylinders where great damping would occur due to throttling and friction.

By further proceeding as disclosed, it is not necessary to overlay the oscillation with a static pressure in order to maintain the oscillation of the part not containing the vibrator arrangement and it is thus ensured that the rearrangement of the material is not hindered during the compacting process.

Finally, the apparatus according to the invention can be designed such that the same hydraulic cylinders with pistons can be used for the means whereby the two parts are gradually carried to each other during the compacting process as well as for the means whereby the apparatus is opened when the compacting is concluded.

The invention will be further described in the following with reference to the drawing wherein.

Figure 3:
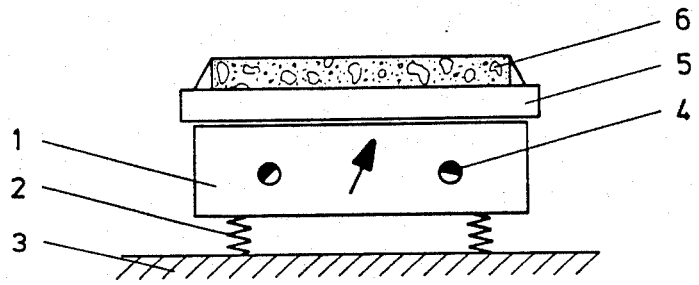
Fig. 3 PRIOR ART
Figure 4:
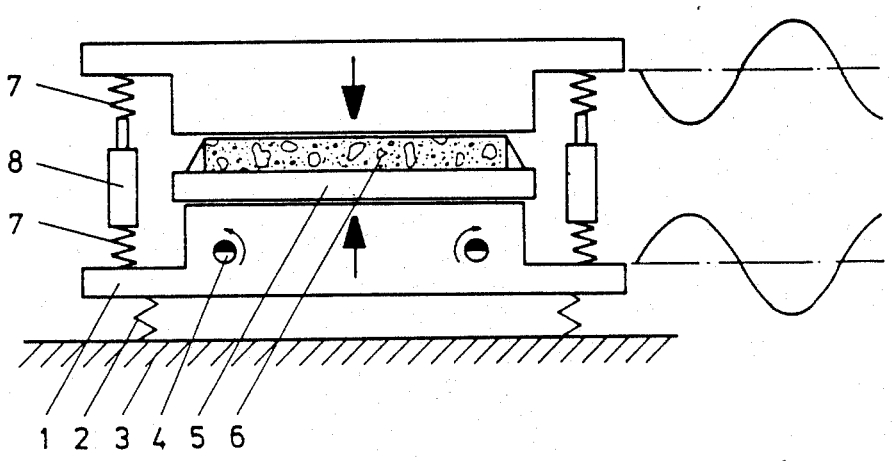
Figure 5:
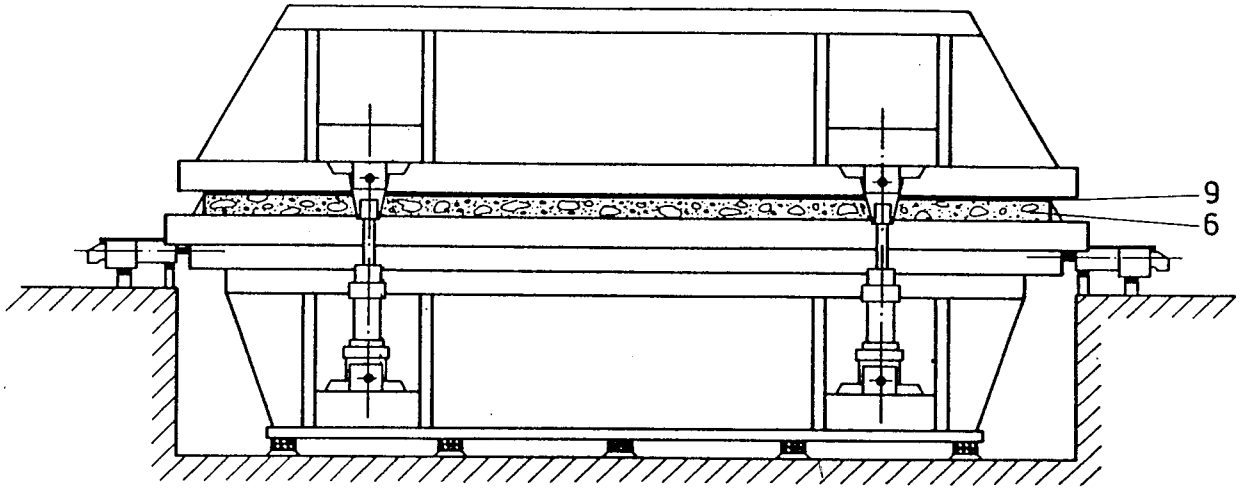
Figure 6:
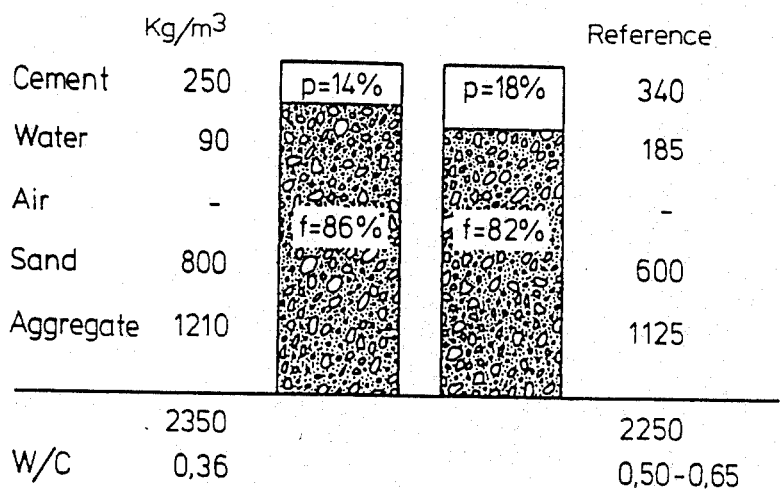
Figure 7:
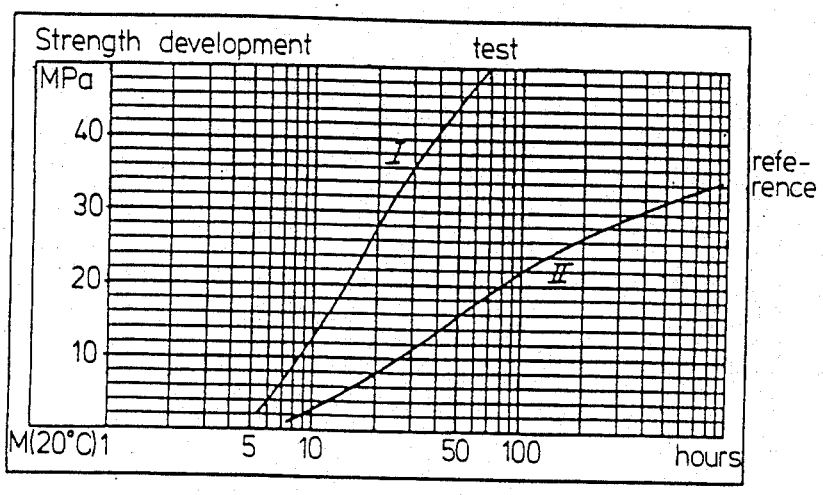

FIG. 3 shows conventional concrete vibration where the vibration is not directional, FIG. 4 shows the principle of the invention with synchronised directional and evenly distributed vibrations imparted to one part (here the lower part) in the compacting machine, FIG. 5 shows the apparatus according to the invention in greater detail, FIG. 6 shows to the left a concrete mix that can be used according to the invention and to the right a concrete mix that can be used by the known machines, and FIG. 7 shows the strength development as a function of time partly by using the invention and partly by using conventional techniques.

Figure 1B:
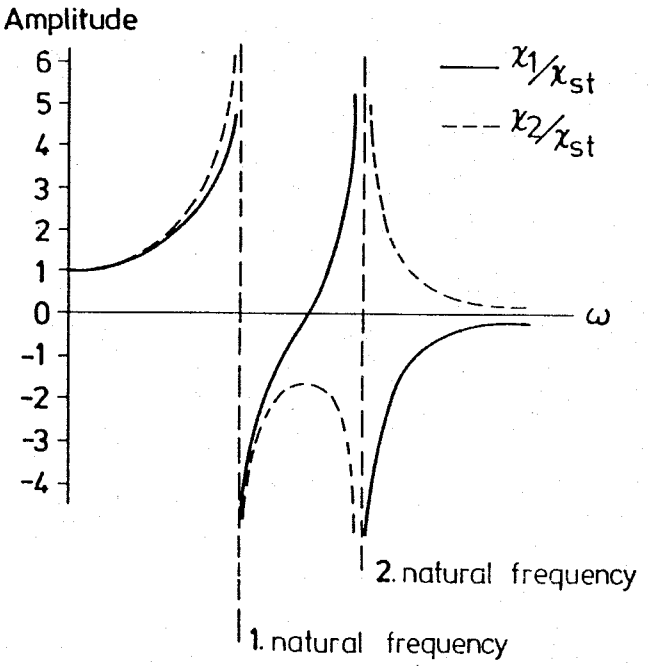
Fig. 1B PRIOR ART
FIG. 1B shows a graph of the oscillation course of a system such as that shown in FIG. 1A.
Figure 1A:
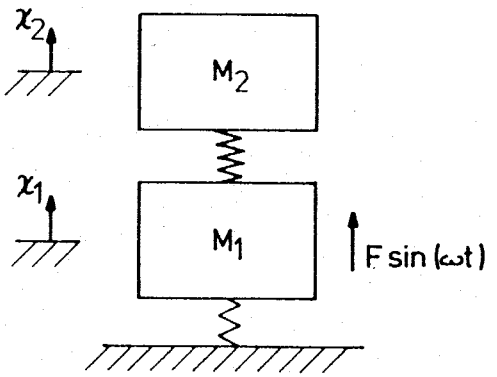
Fig. 1A PRIOR ART
FIG. 1A shows a schematic drawing of a prior art 2-mass oscillatory system.

FIG. 1A of the drawing shows a 2-mass oscillatory system having masses M1 and M2. If synchronised directional vibrators are arranged in one of the parts for example the lower part M1 having the force Fsin ($\omega t$), the masses will oscillate from their positions of rest which is symbolically shown in FIG. 1A by the oscillatory amplitudes X1 and X2 in accordance with generally known oscillation theory. In FIG. 1B of the drawing the oscillatory course is graphically shown as a function of frequency the oscillatory amplitude being shown in relation to the static amplitude.

Figure 2B:
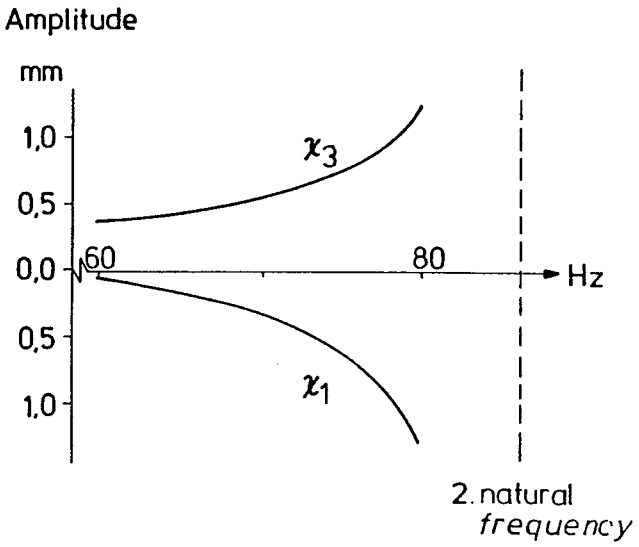
FIG. 2B shows the oscillation course of a system such as that shown in FIG. 2A.
Figure 2A:
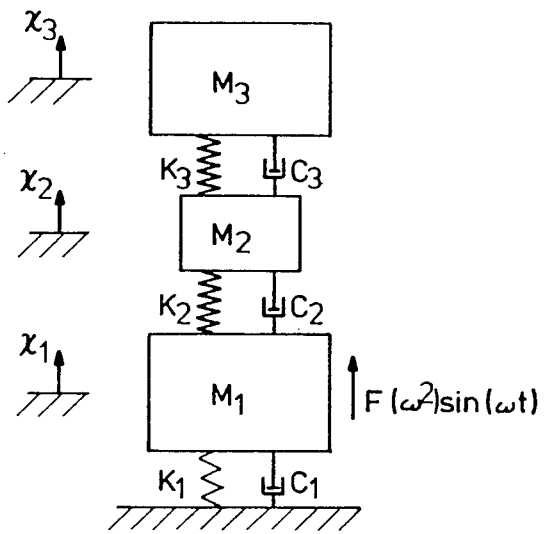
FIG. 2A shows a schematic drawing of a 3-mass oscillatory system according to the instant invention.

In FIG. 2A of the drawing there is shown a 3-mass oscillatory system having masses M1, M2 and M3.

By way of example mass M1 can be the lower part of the machine, mass M2 is the hydraulic cylinders with pistons and mass M3 is the upper part of the machine. The masses are flexibly mounted over each other and rest on a base by means of the spring members each having spring rigidity K1, K2 and K3 and dampings C1, C2 and C3.

If synchronised directional vibrators are arranged in one of the parts, for example in the lower part M1 with the force ($\omega^2$) sin ($\omega t$), the three masses will oscillate from their positions of rest which are symbolically shown in FIG. 2A by the oscillatory amplitudes X1, X2 and X3.

By means of a computer program it is possible to optimise the spring members giving the desired oscillation picture, namely a form of oscillation where upper and lower part oscillate in phase opposition so that the desired impact forces are achieved while the spring forces are kept below a certain level. FIG. 2B shows the oscillation course of upper part X3 and lower part X1 by a picture of the oscillatory amplitudes as a function of the frequency of the vibrators. There are used synchronised rotating oscillation mass vibrators.

It will appear from FIG. 2B that it is both theoretically and technically possible to have upper and lower parts oscillate in phase opposition over a reasonable range, for example in the range of 60–80 Hz.

FIG. 3 of the drawing shows the operation of conventional concrete unit vibrating where a lower part 1 with spring members 2 are placed on a base 3. Vibrators 4 are arranged in the lower part. On top of the lower part there is placed a mould table 5 with a newly poured concrete unit 6. Usually the vibrators 4 are not synchronised and the resulting vibration is therefore not directional.

By the present invention conventional concrete vibration is improved by means of the apparatus shown in FIG. 4.

The apparatus in FIG. 4 forms a 3-mass oscillatory system corresponding to FIG. 2A. The spring members, spring system, situated between upper and lower parts comprise springs 7 and spacer means such as hydraulic cylinders with pistons 8. On either side of pistons 8 there are applied very high hydraulic pressures of the order of 300 Bar so that all oscillation will take place in springs 7. By changing the hydraulic pressures upper part and lower part can be carried towards each other during the vibrating as the rearrangement proceeds.

The vibrational energy is transmitted from lower part to upper part through the flexible units consisting of springs 7 and hydraulic pistons 8 so that the two parts oscillate in phase opposition and close to the second natural frequency, cf. FIG. 2B.

FIG. 5 shows in greater detail how the method and the apparatus according to the invention are carried out and used in practice. The newly poured concrete unit 6 having first and second opposite surfaces is shown prior to the compacting, the fat black stroke 9 showing the excess that is pressed down by the compacting/vibration. By way of example such a machine can compact a storey-high concrete panel or a concrete slab unit in approx. 1 minute by a frequency of between 50 and 80 Hz on the synchronised vibrators. In case of smaller objects and a correspondingly smaller machine such as a concrete product machine, a slab of 100 kg ($\frac{1}{2}$ m$^2$) for example can be compacted in 5–15 seconds by the mentioned frequency area.

Tests have shown that apart from savings in cement, the higher final strength, the faster strength development and the high resistance against of the concrete to physical and chemical action there are also achieved other great advantages in relation to the known machines. Firstly, the noise level is substantially reduced so as to lie several decibel below the level of the known machines. Secondly, oscillations at 2nd natural frequency causes the oscillation energy to remain in the systm so that it is not necessary to place the machine securely anchored in a big and heavy base which is always the case by the known machines.

The machine according to the invention is thus fairly mobile. Finally, the energy consumption have proved to be far less than by the known machines because the machine according to the invention gives a two-side amplification of several times the dynamic forces.

FIG. 6 of the drawing shows to the left a concrete mix which can be used by the method and the apparatus according to the invention, and to the right a concrete mix which is used by the known machines. By the invention it is possible to reduce the water/cement ratio and it is also possible to reduce the absolute content of water and cement so that the pore volume (p) is reduced. There is thus obtained a stronger type of concrete, faster strength development and shorter stripping time. The concrete mix contains no plastifying additives of any kind.

FIG. 7 of the drawing shows the strength development as a function of time partly when using the invention, cure I, and partly when using known techniques, curve II. Both concrete mixes are made with the same Middle East Portland cement at an amount of 300 kg cement per $m^3$ concrete mix.

Test results

A. The basis of the development of the invention has been tests made in the Middle East by the production of hollowcore units with short curing times by using Middle East Portland cement.

By the tests units were stripped at w/c=0.3 and 300 kg cement/$m^3$ after 2 hours' steam curing. After 15 maturity hours (M20), (equivalent curing time at 20° C.) the compressive strength were measured at 20 MPa.

In comparison it should be mentioned that the units obtained by conventional production with the same cement content must have 5 hours' steam curing to achieve the stripping strength 10 MPa., see FIG. 7.

The test results of full scale tests are marked on FIG. 7 of the drawing, curve I.

B. A concrete product machine is built up as shown in FIG. 4 of the drawing but mounted in a framework for mutually centering upper part and lower part. The two parts facing the concrete are ground plane and each have an area of approx. 1 $m^2$. By tests with this machine it was established by measurements made with a two channel oscilloscope and by the use of the stroboscope light that the two parts of the machine oscillate completely as assumed, i.e. the two large masses (upper part and lower part) oscillate in phase opposition and the hydraulic cylinders stand still when a poured concrete unit is compacted.

We claim:

1. An apparatus for compacting newly poured porous raw material such as concrete by directly coupled vibration compacting; said apparatus including two vibrating planes adapted to enclose a unit of porous raw material to be compacted; said apparatus including means whereby only one of the vibrating planes includes synchronized directional vibrators; and, said apparatus being further characterized in that a second plane is coupled with a first plane by means including a spring system dimensioned and tuned so that the two planes may be oscillated in phase opposition at about a 2nd natural frequency of the system with a corresponding dynamic amplification of the amplitudes of plane vibration in relation to impulses imparted from the vibrators; said spring system including spring parts arranged at opposite sides of spacer means operable to gradually reduce a distance between the two planes as compacting of newly poured porous material proceeds.

2. An apparatus according to claim 1 further characterized in that the spacer means is adapted to selectively carry the two planes away from each other when a compacting is concluded.

3. An apparatus for compacting a unit of newly poured porous material, such as concrete, having first and second opposite surfaces; said apparatus comprising:

(a) a first vibrator plane operatively positioned to transmit compacting vibration to the first surface of the unit of newly poured material;

(b) a second vibrator plane operatively positioned to transmit compacting vibration to the second surface of the unit of newly poured material;

(c) a spacer means positioned between said first and second vibrator planes; said spacer means including first and second spring oscillation means;

(i) said first spring oscillation means engaging said spacer means with said first vibrator plane;

(ii) said second spring oscillation means engaging said spacer means with said second vibrator plane; and (iii) said spacer means and first and second vibrator planes forming an oscillation system; and, (d) vibration means for vibrating said first and second vibration planes in phase opposition at about a 2nd natural frequency of said oscillation system;

(e) whereby a unit of newly poured porous material operationally positioned between said first and second vibrator planes may be compacted.

4. An apparatus according to claim 3, wherein:

(a) said spacer means includes means to selectively operationally reduce a distance between said first and second vibrator planes to accomodate for compaction of a unit of newly poured material operationally positioned therebetween.

5. An apparatus according to claim 3, wherein:

(a) said spacer means includes a plurality of hydraulic pistons and cylinder assemblies oriented for selectively moving said first and second vibration planes apart from one another following operation to compact said unit of newly poured porous material.

6. An apparatus according to claim 3, wherein:

(a) said vibration means comprises a plurality of vibrators in direct engagement with said first vibration plane; and (b) said second vibration plane is without a vibrator in direct engagement therewith and selectively vibrates substantially only in response to motion generated by said vibrators in direct engagement with said first vibration plane.

* * * * *